US010273066B2

(12) United States Patent
Gupta et al.

(10) Patent No.: US 10,273,066 B2
(45) Date of Patent: Apr. 30, 2019

(54) CARTON-LESS YARN BOBBIN PACKAGE AND CARTON-LESS YARN PACKING UNIT

(71) Applicant: Wellknown Polyesters Ltd, Nani Daman, Daman (IN)

(72) Inventors: Anil Madanlal Gupta, Daman (IN); Hari Vallabh Ichhaneath Bhatt, Daman (IN); Ram Prakash Baijnath Shah, Daman (IN); Venkata Subrahmanya Gopalarao Mullapudi, Daman (IN); Natarajan Shivkumar, Daman (IN); Chand Vir Khandelwal, Daman (IN)

(73) Assignee: WELLKNOWN POLYESTERS LTD, Nani Daman, Daman (IN)

( * ) Notice: Subject to any disclaimer, the term of this patent is extended or adjusted under 35 U.S.C. 154(b) by 0 days.

(21) Appl. No.: 15/296,447

(22) Filed: Oct. 18, 2016

(65) Prior Publication Data

US 2017/0107036 A1 Apr. 20, 2017

(30) Foreign Application Priority Data

Oct. 19, 2015 (IN) ..... 3958/MUM/2015

(51) Int. Cl.
*B65D 71/50* (2006.01)
*B65D 85/67* (2006.01)
*B65D 71/70* (2006.01)

(52) U.S. Cl.
CPC ..... *B65D 71/50* (2013.01); *B65D 71/70* (2013.01); *B65D 85/67* (2013.01)

(58) Field of Classification Search
CPC ..... B65D 19/00; B65D 19/004; B65D 19/06; B65D 19/38; B65D 21/02; B65D 71/00; B65D 71/50; B65D 71/70; B65D 85/67; B65D 85/676; B65D 85/02; B65H 49/36; B65H 49/38; B65H 49/00
USPC ..... 206/386, 391–394
See application file for complete search history.

(56) References Cited

U.S. PATENT DOCUMENTS 2,764,285 A * 9/1956 Prossen ..... B65D 71/70 206/392
3,220,545 A * 11/1965 Scott ..... B65D 71/70 206/392
3,227,272 A * 1/1966 Critzer ..... B65D 71/70 206/392
3,624,776 A * 11/1971 Gordon ..... B65D 71/70 206/392
4,516,677 A * 5/1985 Rowland ..... B65D 71/70 206/391
4,580,680 A * 4/1986 Wind ..... B65D 19/004 206/392
4,967,907 A * 11/1990 Pozzi ..... D06B 23/04 206/392

(Continued)

FOREIGN PATENT DOCUMENTS

FR 1593225 A * 5/1970 ..... B65D 71/70
FR 2660296 A1 * 10/1991 ..... B65D 71/70

*Primary Examiner* — Bryon P Gehman
(74) *Attorney, Agent, or Firm* — Tim Tingkang Xia, Esq.; Locke Lord LLP

(57) ABSTRACT

The carton-less yarn bobbin package includes at least one row of yarn bobbins having a bottom layer and at least one top layer of yarn bobbins located and centered in position and tightly packed in a protective, disassemblable, durable, mechanically strong, rigid and cushioning packing unit.

6 Claims, 5 Drawing Sheets

(56) References Cited

U.S. PATENT DOCUMENTS

| | | | | | |
|---|---|---|---|---|---|
| 4,998,619 | A * | 3/1991 | Sowa | B65D 71/70 | 206/392 |
| 5,758,771 | A * | 6/1998 | Rose | B65D 71/0096 | 206/391 |
| 6,047,523 | A * | 4/2000 | Eyre | B65B 11/025 | 206/391 |
| 6,068,124 | A * | 5/2000 | Lin | B65D 19/44 | 206/391 |
| 6,899,225 | B2 * | 5/2005 | Shuert | B65D 71/70 | 206/392 |

* cited by examiner

CARTON-LESS YARN BOBBIN PACKAGE AND CARTON-LESS YARN PACKING UNIT

CROSS-REFERENCE TO RELATED APPLICATION

This application claims priority to and benefit of Indian Patent Application No. 3958/MUM/2015, filed Oct. 19, 2015, which is hereby incorporated herein in its entirety by reference.

FIELD OF THE INVENTION

This invention relates to a carton-less yarn bobbin package and a carton-less yarn packing unit.

BACKGROUND OF THE INVENTION

A yarn bobbin comprises a yarn wrap or bundle wound on a bobbin tube (spool), usually paper bobbin tube, with the ends of the tube protruding out of the yarn wrap. The yarns include cotton yarns and polyester yarns such as partially oriented yarns (POY), fully drawn yarns (FDY), draw texturised yarns (DTY) and air tex yarns (ATY). The yarn bobbins are packed and transported to user destinations such as large scale weavers such as weaving mills or small scale weavers or individual weavers for making fabrics or to yarn dealers, distributors or merchants. There are various packing modes for yarn bobbins like corrugated cellulose paper cartons or boxes, bulk packs, bulk heads and containers.

Packing of yarn bobbins in corrugated cellulose paper cartons or boxes is a compact way of packing yarn bobbins and is comparatively cost effective. Yarn bobbins packed in paper cartons or boxes are also comparatively light weight and easy to handle. Yarn bobbins are packed in a paper carton in one or more rows of yarn bobbins located longitudinally in the carton. Each row of yarn bobbins comprises a bottom layer of yarn bobbins and at least one top layer of yarn bobbins aligned vertically. In each pair of yarn bobbins consisting of a bottom yarn bobbin in the bottom layer and corresponding top yarn bobbin in the top layer, the end of the bobbin tube of the top yarn bobbin protruding down from the respective yarn wrap rests against the end of the bobbin tube of the bottom yarn bobbin protruding up from the respective yarn wrap. One or more corrugated cellulose paper separator sheets are located between the bottom layer of yarn bobbins and the top layer of yarn bobbins and one or more corrugated cellulose paper support sheets are located between the bottom surface of the bottom layer of yarn bobbins and the carton bottom surface and between the top surface of the top layer of yarn bobbins and the carton top surface. The yarn bobbins are tightly held together by strapping with straps tightened over the carton.

Packages of yarn bobbins packed in cellulose paper cartons are loaded on a pallet and tightly held on to the pallet by strapping with straps tightened around the cartons and the pallet. The pallet with the cartons consisting of the yarn bobbins are transported to the user destinations. During loading the pallet with the yarn bobbins into vehicles and unloading of the pallet with the yarn bobbins from the vehicles and also during transportation of the yarn bobbins to destinations in vehicles, there are chances for the paper cartons with the yarn bundles wound on the bobbin tubes to get compressed and deformed due to impacts experienced by the cartons and yarn bundles while being handled and due to jerks and bumps experienced by the vehicles on the roads because of the poor mechanical strength and delicate nature of the paper cartons and paper support sheets and separator sheets and because of the yarn bobbins being not held in position in the cartons. The force of the impacts and jerks and bumps is easily transmitted to the yarn bundles in the cartons.

Because of the compression and deformation that the yarn wraps are subjected to, the yarn bundles may not unwind from the bobbin tubes easily during weaving of fabrics with the yarn bobbins thereby resulting in wastage of yarn material and loss of money. Paper cartons with the support sheets and separator sheets are usually thrown away after unpacking the yarn bobbins from the cartons at the destinations. This not only creates waste disposal and environmental problems but also results in wastage of money.

There is, therefore, need for carton-less yarn bobbin packages and carton-less yarn packing units, in which yarn bobbins are held tightly in position against impacts and which obviate the problems in the prior art and which are cost effective, efficient and reusable.

SUMMARY OF THE INVENTION

According to the invention there is provided a carton-less yarn bobbin package comprising at least one row of yarn bobbins having a bottom layer of yarn bobbins and at least one top layer of yarn bobbins, each layer of yarn bobbins comprising equal number of yarn bobbins and each yarn bobbin comprising a bobbin tube and a yarn wrap wound on the bobbin tube with the bobbin tube ends protruding out of the yarn wrap, each bottom yarn bobbin in the bottom layer of yarn bobbins being aligned vertically with each top yarn bobbin in the top layer of yarn bobbins to form a pair or set of yarn bobbins with the end of the bobbin tube of the top yarn bobbin protruding down from the respective yarn wrap resting against the end of the bobbin tube of the bottom yarn bobbin protruding up from the respective yarn wrap, wherein the row of yarn bobbins is located and centered in position and tightly packed in a protective, disassemblable, durable, mechanically strong, rigid and cushioning packing unit.

According to the invention there is also provided a protective, disassemblable, durable, mechanically strong, rigid and cushioning carton-less yarn packing unit for packing and tightly holding in position at least one row of yarn bobbins, wherein the row of yarn bobbins comprises a bottom layer of yarn bobbins and at least one top layer of yarn bobbins, each layer of yarn bobbins comprising equal number of yarn bobbins and each yarn bobbin comprising a bobbin tube and a yarn wrap wound on the bobbin tube with the bobbin tube ends protruding out of the yarn wrap and wherein the packing unit comprises a base support plate and a top support plate, each made of a durable, mechanically strong, rigid material and each having a width larger than the outer diameter of the yarn wraps and a row of bobbin tube locating and centering circular recesses along the centre of the inner side thereof corresponding to the number of yarn bobbins in each layer of yarn bobbins and strap engaging means at the ends and sides thereof, the row of yarn bobbins being locatable at the bottom against the base support plate with the ends of the bobbin tubes protruding down from the respective yarn wraps of the bottom layer of yarn bobbins located and centered in the tube locating and centering recesses in the base support plate and the ends of the bobbin tubes protruding up from the respective yarn wraps of the top layer of yarn bobbins located and centered in the tube locating and centering recesses in the top support plate and the ends of the bobbin tubes of the top layer of yarn bobbins protruding down from the respective yarn wraps resting against the ends of the bobbin tubes of the bottom layer of yarn bobbins protruding up from the respective yarn wraps and the sides of the base support plate and top support plate extending over the yarn wraps, a durable, cushioning support layer locatable between the base support plate and the bottom surface of the bottom bobbin layer and between the top support plate and the top surface of the top bobbin layer, a durable, cushioning separator layer locatable between the bottom bobbin layer and the top bobbin layer, the durable cushioning support layers and the durable cushioning separator layer each having as many holes as there are yarn bobbins in the bottom layer of yarn bobbins and the top layer of yarn bobbins matching in position and size with the outer diameter of the bobbin tubes for the bobbin tubes to pass therethrough and for the yarn wraps to abut against the cushioning support layers and cushioning separator layer and tightening straps engageable in the strap engaging means at the ends and sides of the base support plate and top support plate to tightly hold in position the support plate and the top support plate with the row of yarn bobbins located and centered therebetween.

DETAILED DESCRIPTION OF THE INVENTION

Figure 1:
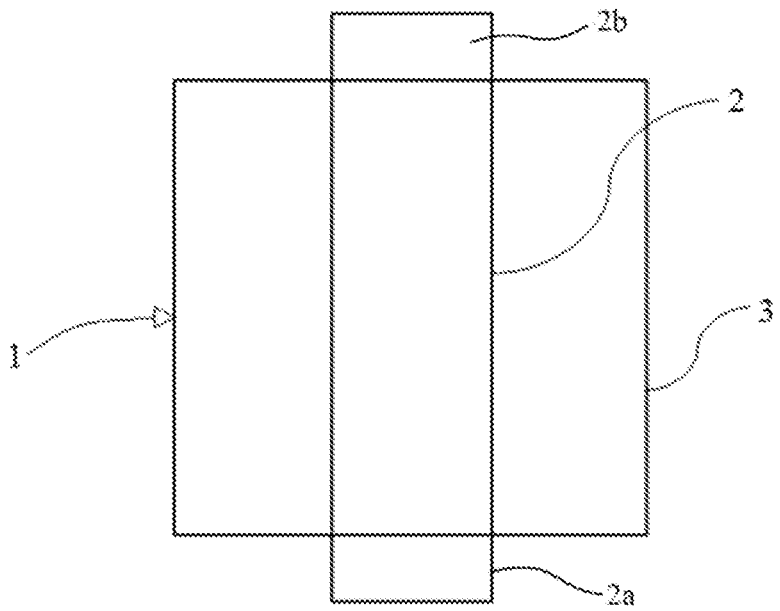
FIG. 1 of the accompanying drawings is a schematic sectional view of a yarn bobbin.
Figure 2:
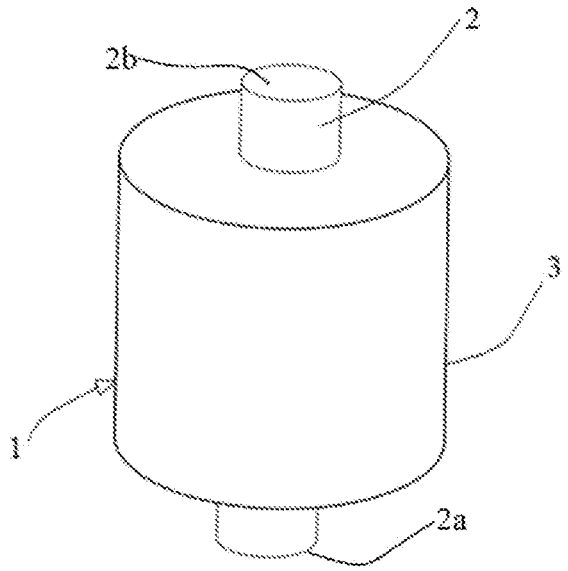
FIG. 2 of the accompanying drawings is a schematic isometric view of the yarn bobbin of FIG. 1.
Figure 3:
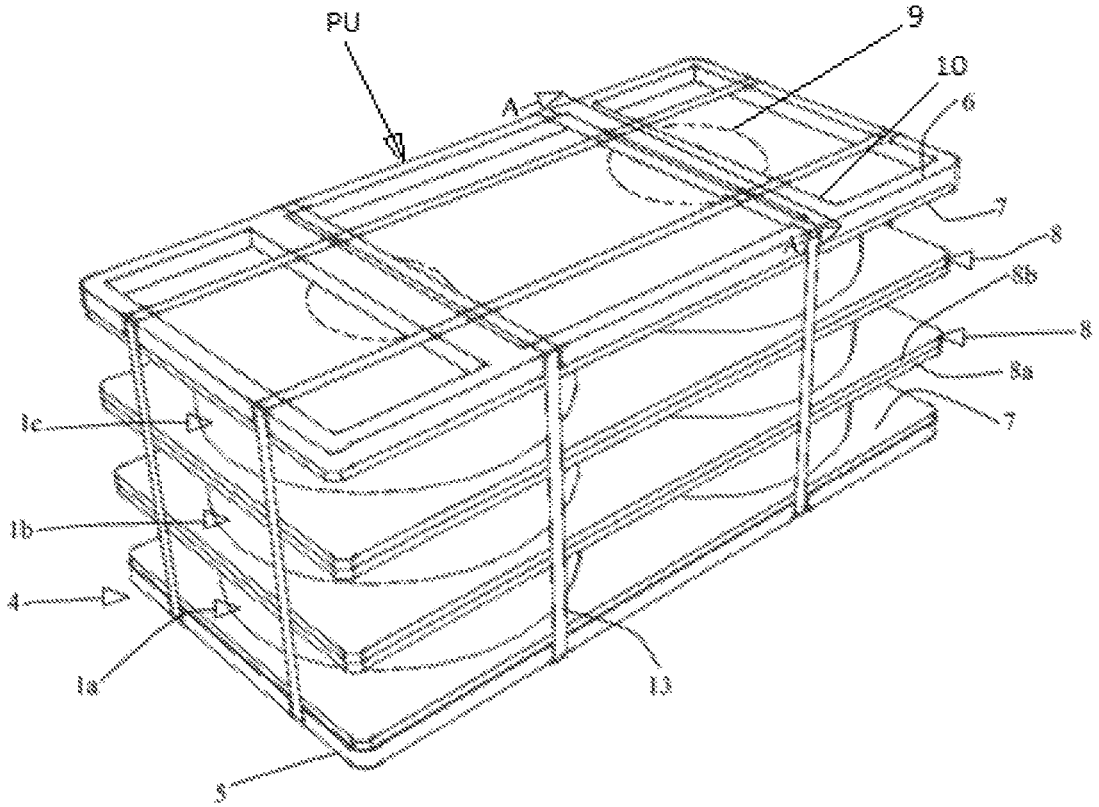
FIG. 3 of the accompanying drawings is a schematic isometric view of the carton-less yarn bobbin package according to an embodiment of the invention.
Figure 4:
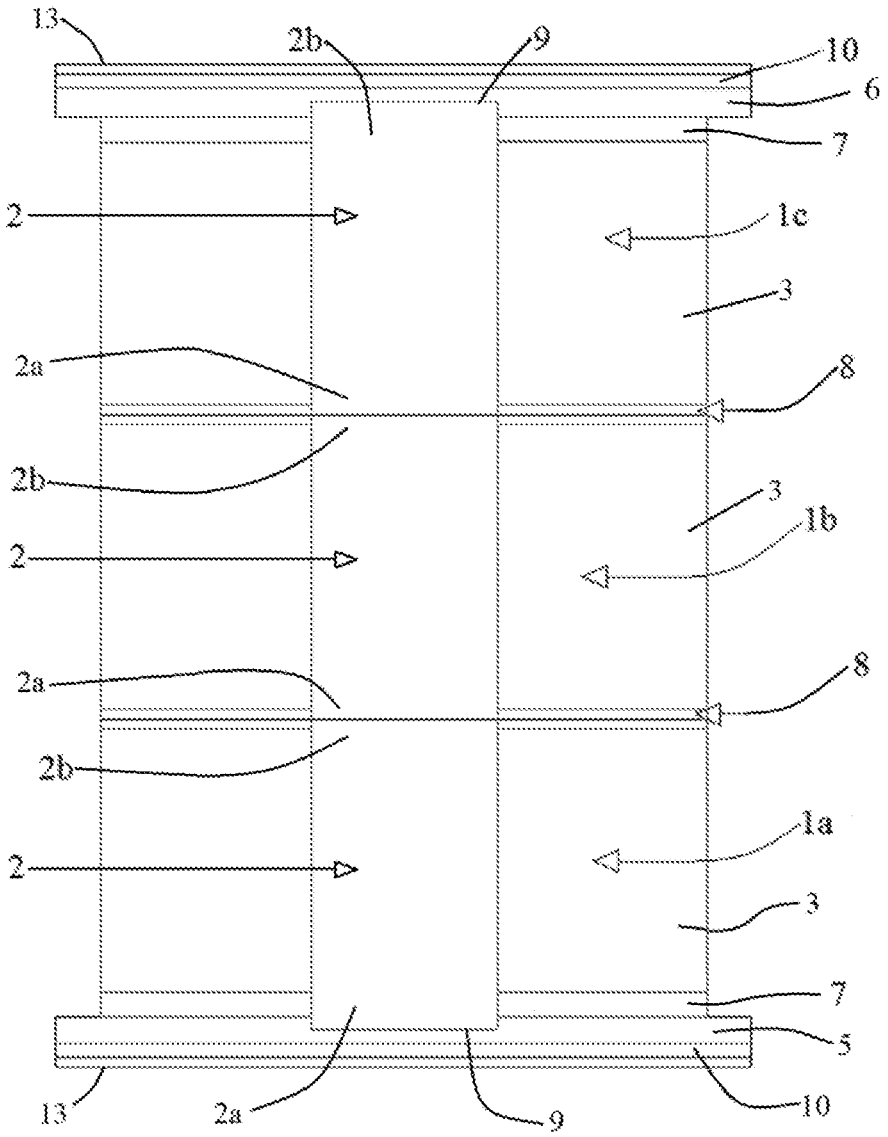
FIG. 4 of the accompanying drawings is a section at A-A in FIG. 3.
Figure 5:
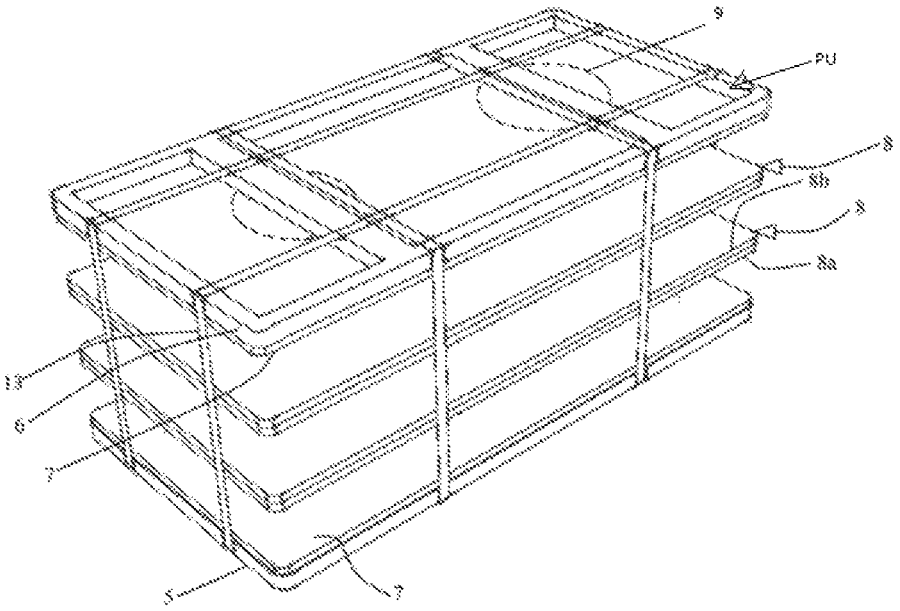
FIG. 5 of the accompanying drawings is a schematic isometric view of the packing unit of the bobbin package of FIG. 3.
Figure 6:
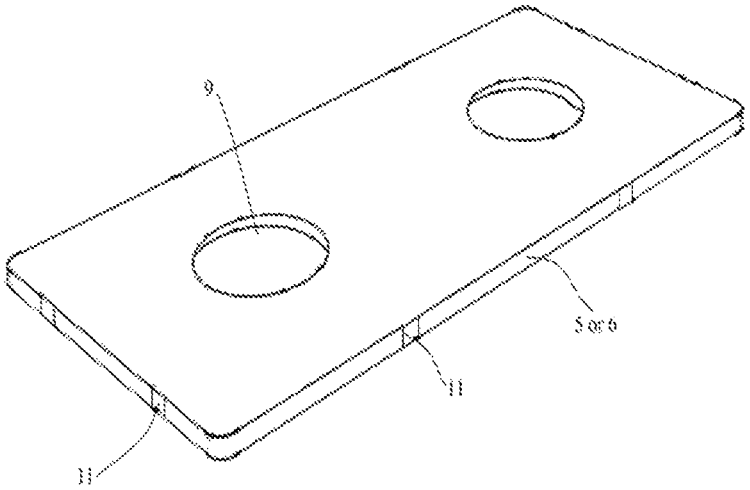
FIGS. 6 and 7 are inner side and outer side isometric views of the base support plate or top support plate of the packing unit of FIG. 5.
Figure 7:
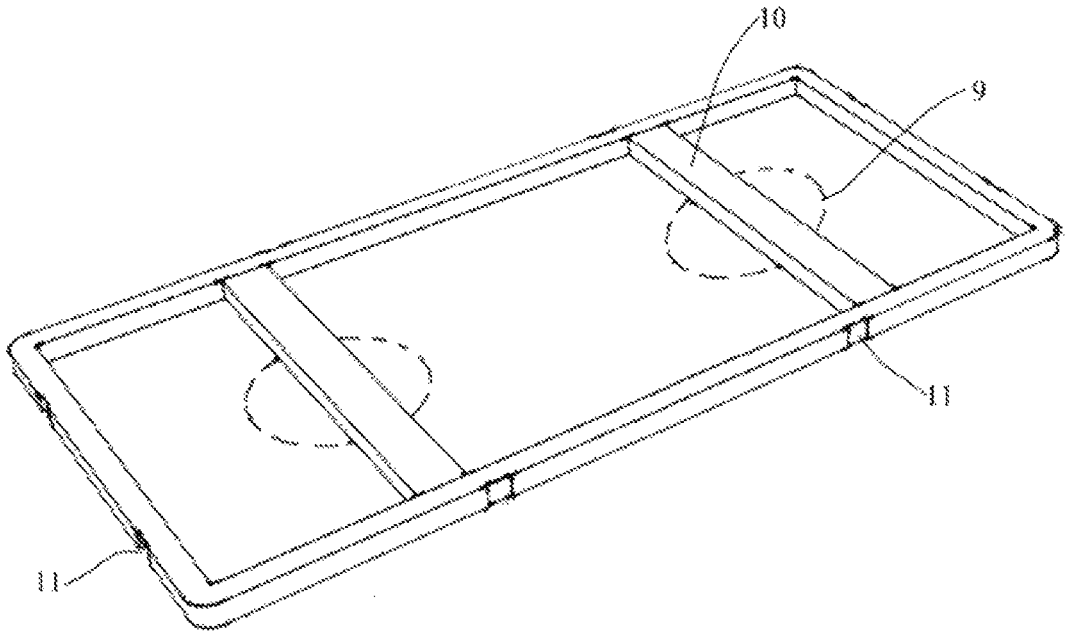
Figure 8:
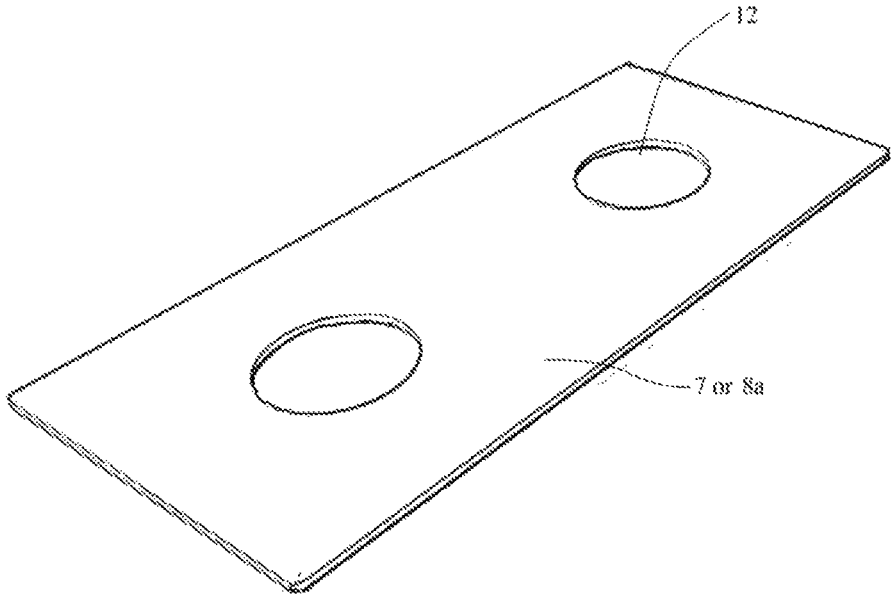
FIG. 8 is an isometric view of a durable, flexible material sheet of the durable cushioning support layer of the yarn package of FIG. 3 or the durable, cushioning separator layer of the yarn package of FIG. 3.

A yarn bobbin 1 as illustrated in FIGS. 1 and 2 of the accompanying drawings comprises a bobbin tube 2 (spool), usually paper tube, and a yarn wrap or bundle 3 wound on the bobbin tube with the ends 2*a*, 2*b* of the bobbin tube protruding out of the yarn wrap.

The carton-less yarn bobbin package 4 as illustrated in FIGS. 3 to 8 of the accompanying drawings comprises one row of yarn bobbins having a bottom layer of yarn bobbins 1*a*, an intermediate top layer of yarn bobbins 1*b* and a top layer of yarn bobbins 1*c*. All the layers of yarn bobbins have the same number of yarn bobbins aligned with one another vertically. It should be understood that there can be more than one row of yarn bobbins and that each layer of yarn bobbins can have more than two yarn bobbins. Only one row of yarn bobbins and only two yarn bobbins in each layer have been illustrated and explained for ease and convenience of illustration and explanation and as it is sufficient to understand and appreciate the invention. It should be also understood that a row of yarn bobbins may comprise one top layer of yarn bobbins or more than two top layers of yarn bobbins.

The row of yarn bobbins is located and centered in position and tightly packed in a protective, dissemblable, durable, mechanically strong, rigid and cushioning packing unit PU comprising a base support plate 5 and a top support plate 6. The row of yarn bobbins is supported at the bottom against the base support plate 5 and at the top against the top support plate 6 along the length thereof. A durable, cushioning support layer 7 is located between the base support plate and the bottom surface of the bottom bobbin layer 1*a* and between the top support plate and the top surface of the top bobbin layer 1*c*. The bottom bobbin layer 1*a*, intermediate top bobbin layer 1*b* and top bobbin layer 1*c* are separated from each other by durable, cushioning separator layers 8 located between the bottom bobbin layer and intermediate top bobbin layer and between the intermediate top bobbin layer and top bobbin layer.

Both the base support plate and top support plate are made of durable, mechanically strong rigid material such as metal or rigid plastics, preferably mild steel and are identical in construction. Each of the plates has a row of bobbin locating and centering circular recesses 9 along the centre of the inner side or surface thereof corresponding to the sets of bottom yarn bobbin, intermediate top yarn bobbin and top yarn bobbin vertically in a line in the respective layers of the yarn bobbins matching in position and size with the outer diameter of the bobbin tubes so as to seat, centre and balance the bobbin tubes in position against the base support plate and top support plate as explained in the following description. The base support plate and top support plate each has reinforcing ribs 10 across the recesses at the outer side or surface thereof. Both the base support plate and top support plate also have strap engaging open slots 11 at the ends and sides thereof.

Each of the durable, cushioning support layer 7 consists of a durable, flexible material sheet. However, the support layer may consist of two or more durable, flexible material sheets. Each of the separator layer 8 consists of two durable, flexible material sheets 8*a*. However, the separator layer may consist of one or more than two durable, flexible material sheets. The durable, flexible material sheets are preferably extruded polypropylene sheets, still preferably extruded corrugated polypropylene sheets. However, the durable, flexible material sheets can be of any other durable, elastic and flexible materials.

Each of the durable, flexible material sheets has as many holes 12 as there are sets of yarn bobbins comprising bottom yarn bobbins in the bottom layer of yarn bobbins and corresponding intermediate top yarn bobbin and top yarn bobbin in the intermediate top and top layers of yarn bobbins vertically in a line matching in position and size with the outer diameter of the bobbin tubes 2 for the bobbin tubes to pass therethrough and for the yarn bundles 3 to abut against the flexible material sheets. In each of the sets of yarn bobbins vertically in a line, the end of the bobbin tube of the intermediate top yarn bobbin protruding down from the respective yarn wrap rests against the end of the bobbin tube of the corresponding bottom yarn bobbin protruding up from the respective yarn wrap and the end of the bobbin tube of the top yarn bobbin protruding down from the respective yarn wrap rests against the end of the bobbin tube of the intermediate top yarn bobbin protruding up from the respective yarn wrap and the end of the bobbin tube of the bottom yarn bobbin protruding down from the respective yarn wrap is located, centered and balanced in position in the corresponding recess 9 in the base support plate and the end of the bobbin tube of the top yarn bobbin protruding up from the respective yarn wrap is located, centered and balanced in position in the corresponding recess 9 in the top support plate. The sides of the bottom support plate and top support plate extend over and beyond the yarn wraps to prevent damage to the yarn wraps and thus protect the year wraps.

The base support plate and top support plate with the row of yarn bobbins and the respective cushioning support layers and cushioning separator layers are tightly held together in position with tightening straps 13 engaged in the strap engaging slots in the base support plate and top support plate and tightened over the base support plate and top support plate. The carton-less yarn bobbin packages are further packed on pallets (not shown) and transported to user destinations in vehicles. Instead of open slots, the strap engaging means can be of a different construction or design. The straps may be with buckles or other fastening means or elements.

According to the invention the yarn bobbins are tightly held in position between the durable, mechanically strong, rigid base support plate and top support plate with the bobbin tubes of each set of yarn bobbins supported against one another and located, centered and balanced in the recesses in the base support plate and top support plate and cushioned by the bottom and top support layers and the separator layers. The sides of the bottom and top support plates extend over and protect the yearn wraps. Therefore, during handling of the yarn bobbin packages both at the loading station and at the unloading station and during transportation of the yarn bobbin packages, the base support plate and the top support plate are mechanically strong and rigid enough to withstand and absorb impacts on the bobbin packages. The yarn bobbins are also cushioned by the support layers and separator layers because of their flexible and elastic and spring characteristics and nature thereof. Therefore, the yarn bobbins continue to remain in position unaffected by the forces of impacts, jerks and bumps experienced by the yarn bobbin packages. As a result, the yarn bobbins do not get compressed and deformed and they unwind from the bobbin tubes easily during weaving thereby eliminating wastage of yarn material and loss of money.

Besides, the yarn packing unit or kit comprising the base support plate and top support plate made of durable, mechanically strong, rigid materials are reusable and can be assembled and disassembled easily by loosening and tightening with the straps. The cushioning support layers and cushioning separator layers are also durable. The straps are also reusable. Therefore, the yarn packing unit of the invention can be reused several times before being discarded. This reduces disposal and environmental problems and saves cost. Metallic base support plate and top support plate will have some scrap value even after repeated use.

We claim:

1. A protective, disassemblable, durable, mechanically strong, rigid and cushioning carton-less yarn packing unit (PU) for packing and tightly holding in position at least one row of yarn bobbins (1), the at least one row of yarn bobbins comprising a bottom layer of yarn bobbins (1*a*) and at least one top layer of yarn bobbins (1*b*, 1*c*), each layer of yarn bobbins comprising an equal number of yarn bobbins and each yarn bobbin (1) comprising a bobbin tube (2) and a yarn wrap (3) wound on the bobbin tube (2) with two bobbin tube ends (2*a*, 2*b*) protruding out of the yarn wrap (3) and the packing unit comprising a base support plate (5) and a top support plate (6), each made of a durable, mechanically strong, rigid material, the at least one row of yarn bobbins being packable between the base support plates (5) and the top support plates (6), wherein each of the base and top support plates (5, 6) includes circular recesses (9) formed on an inner side thereof, a row of bobbin tubes locating and centering in the circular recesses (9) along the respective inner side thereof corresponding to the number of yarn bobbins in each layer of yarn bobbins and strap engaging means (11) at the ends and sides of the bobbins, the at least one row of yarn bobbins being locatable against the base support plate (5) with ends of the bobbin tubes protruding down from the respective yarn wraps of the bottom layer of yarn bobbins located and centered in the tube locating and centering circular recesses (9) in the base support plate (5) and the ends of the bobbin tubes protruding up from the respective yarn wraps of the top layer of yarn bobbins located and centered in the tube locating and centering circular recesses (9) in the top support plate (6) and the ends of the bobbin tubes of the top layer of yarn bobbins protruding down from the respective yarn wraps resting against the ends of the bobbin tubes of the bottom layer of yarn bobbins protruding up from the respective yarn wraps and the sides of the base support plate (5) and the top support plate (6) extending over the yarn wraps, a durable, cushioning support layer (7) locatable between the base support plate (5) and the bottom surface of the bottom bobbin layer (1*a*) and between the top support plate (6) and the top surface of the top bobbin layer (1*c*), a durable, cushioning separator layer (8) locatable between the bottom bobbin layer and the top bobbin layer, the durable, cushioning support layers and the durable, cushioning separator layer each having as many holes (12) in a line as there are yarn bobbins in the bottom layer of yarn bobbins and the top layer of yarn bobbins matching in position and size with the outer diameter of the bobbin tubes for the bobbin tubes to pass therethrough and for the yarn wraps to abut against the cushioning support layers and cushioning separator layer and tightening straps engageable in the strap engaging slots at the ends and sides of the base support plate and top support plate to tightly hold in position the base support plate and the top support plate with the at least one row of yarn bobbins located and centered therebetween, wherein the bobbin tubes locating at the circular recesses (9) at the inner sides of the base support plate (5) and the top support plate (6) are reinforced with ribs (10), wherein the ribs (10) are formed on outer sides of the base support plate (5) and the top support plate (6) and are parallel to each other, and the ribs (10) are respectively extended across the circular recesses (9) on the outer sides of the base support plate (5) and the top support plate (6), and wherein the outer sides of the base support plate (5) and the top support plate (6) are respectively opposite to the inner sides of the base support plate (5) and the top support plate (6).

2. The yarn packing unit as claimed in claim 1, wherein the base support plate and top support plate are made of metal.

3. The yarn packing unit as claimed in claim 1, wherein the base support plate and top support plate are made of mild steel.

4. The yarn packing unit as claimed in claim 1, wherein the strap engaging slots at the ends of the base support plate and top support plate comprises strap engaging open slots (11).

5. The yarn packing unit as claimed in claim 1, wherein the durable, cushioning support layers and the durable, cushioning separator layer each consists of at least one durable flexible material sheet.

6. The yarn packing unit as claimed in claim 5, wherein the durable, flexible material sheet is extruded polypropylene sheet or extruded corrugated polypropylene sheet.

* * * * *